US009722353B2

(12) United States Patent
Maki et al.

(10) Patent No.: US 9,722,353 B2
(45) Date of Patent: Aug. 1, 2017

(54) CONNECTOR WITH ALIGNMENT FUNCTION

(71) Applicants: AutoNetworks Technologies, Ltd., Yokkaichi, Mie (JP); Sumitomo Wiring Systems, Ltd., Yokkaichi, Mie (JP); SUMITOMO ELECTRIC INDUSTRIES, LTD., Osaka-shi, Osaka (JP)

(72) Inventors: Tomohide Maki, Mie (JP); Kosuke Sone, Mie (JP); Katsushi Miyazaki, Mie (JP)

(73) Assignees: AUTONETWORKS TECHNOLOGIES, LTD., Yokkaichi, Mie (JP); SUMITOMO WIRING SYSTEMS, LTD., Yokkaichi, Mie (JP); SUMITOMO ELECTRIC INDUSTRIES, LTD., Osaka-Shi, Osaka (JP)

( * ) Notice: Subject to any disclaimer, the term of this patent is extended or adjusted under 35 U.S.C. 154(b) by 0 days.

(21) Appl. No.: 15/127,069

(22) PCT Filed: Mar. 20, 2015

(86) PCT No.: PCT/JP2015/058412
§ 371 (c)(1),
(2) Date: Sep. 19, 2016

(87) PCT Pub. No.: WO2015/156100
PCT Pub. Date: Oct. 15, 2015

(65) Prior Publication Data

US 2017/0117666 A1 Apr. 27, 2017

(30) Foreign Application Priority Data

Apr. 10, 2014 (JP) ..... 2014-080838

(51) Int. Cl.
*H01R 13/631* (2006.01)
*H01R 13/627* (2006.01)
*H01R 12/91* (2011.01)

(52) U.S. Cl.
CPC ..... *H01R 13/6315* (2013.01); *H01R 12/91* (2013.01); *H01R 13/6275* (2013.01); *H01R 2201/26* (2013.01)

(58) Field of Classification Search
CPC ..... H01R 12/91; H01R 13/6315
See application file for complete search history.

(56) References Cited

U.S. PATENT DOCUMENTS 4,909,748 A * 3/1990 Kozono ..... H01R 13/6315 439/247
D322,958 S * 1/1992 Maejima ..... D13/147
(Continued)

FOREIGN PATENT DOCUMENTS

JP 11-54210 2/1999
JP 2001-126815 5/2001
(Continued)

OTHER PUBLICATIONS

International Search Report of Jun. 9, 2015.

*Primary Examiner* — James Harvey
(74) *Attorney, Agent, or Firm* — Gerald E. Hespos; Michael J. Porco; Matthew T. Hespos

(57) ABSTRACT

It is aimed to smoothly connect connectors by absorbing assembling variations between the connectors. A first spring piece (24) and a pair of second spring pieces (27) are deflectably provided in a holder portion (H) to resiliently sandwich a first connector (6) in a Y-axis direction. The second spring pieces (27) are formed with upper receiving surfaces (29) symmetrically inclined along an X-axis direction so that resilient forces act on both receiving portions (18) of the first connector (6) toward a center axis along the
(Continued)

X-axis direction. Further, the first connector (6) is held in a state displaceable also in a Z-axis direction in the holder portion (H). This causes the first connector (6) to be held at a reference position and held in a three-dimensionally displaceable state.

8 Claims, 7 Drawing Sheets

(56) References Cited

U.S. PATENT DOCUMENTS

| | | | | |
|---|---|---|---|---|
| 5,919,057 | A * | 7/1999 | Kameyama | H01R 13/6315 439/364 |
| 5,931,688 | A * | 8/1999 | Hasz | H01R 13/6315 439/247 |
| 8,016,609 | B1 * | 9/2011 | Lin | H01R 13/426 439/483 |
| 2001/0019912 | A1 * | 9/2001 | Kain | H01R 12/724 439/247 |
| 2003/0083686 | A1 * | 5/2003 | Freeman | A61B 5/15178 606/181 |
| 2003/0162429 | A1 * | 8/2003 | Sato | B41J 29/02 439/246 |
| 2015/0111419 | A1 * | 4/2015 | Komiyama | H01R 13/11 439/510 |
| 2016/0344137 | A1 * | 11/2016 | Sone | F16H 61/0006 |

FOREIGN PATENT DOCUMENTS

| | | |
|---|---|---|
| JP | 2005-190720 | 7/2005 |
| JP | 2010-216552 | 9/2010 |
| JP | 2010-267488 | 11/2010 |
| JP | 2014-26907 | 2/2014 |

* cited by examiner

CONNECTOR WITH ALIGNMENT FUNCTION

BACKGROUND

1. Field of the Invention

The present invention relates to a connector with alignment function.

2. Description of the Related Art

A connector of Japanese Unexamined Patent Publication No. 2005-190720 is provided with a housing (plug housing) connectable to a mating housing (receptacle housing). The housing includes a plurality of resilient engaging portions. The housing is inserted into a hole provided on a panel partition wall and each resilient engaging portion comes into contact with a peripheral edge part of the hole so that the housing is supported on the panel partition wall swingably in a direction perpendicular to a connecting direction.

The above-described conventional connector can absorb a connection error of the two housings by being swung and displaced in the direction perpendicular to the connecting direction via each resilient engaging portion with the housing inserted in the hole of the panel partition wall. Accordingly, a technique of the above connector cannot be applied in the absence of a structure equivalent to the hole of the panel partition wall. For example, the overall configuration would be complicated if used with a hydraulic control device of an automatic transmission in which a connector is mounted together with an electronic control unit, a hydraulic sensor and the like. Thus, if an operation of connecting the housing to the mating housing requires time and labor, an assembling operation of other components also is affected, thereby causing a problem of drastically reducing operation efficiency.

The present invention was completed based on the above situation and aims to proceed smoothly with a connector connecting operation and improve assembling operation efficiency.

SUMMARY

The present invention is directed to a connector assembly with an alignment function. The connector assembly comprises first and second connectors and a holder. The first connector includes a deflectable lock arm and is mountable into the holder. The first connector defines a waiting side. The second connector is connectable to the first connector and is lockable by the lock arm. Spring portions are interposed between the holder and the first connector for aligning the first connector with a reference position. The spring portions include a Y-direction spring portion and an X-direction spring portion. The Y-axis spring portion is arranged at a position across a center axis at the time of connecting the first and second connectors in a Y-axis direction, which is a deflecting direction of the lock arm, and is configured to bias the first connector toward the reference position. The X-direction spring portion is arranged at a position across the center axis in an X-axis direction, which is a direction perpendicular to the Y-axis, and is configured to bias the first connector toward the reference position.

If relative mounting positions vary between the first and second connectors and the center axes of the connectors deviate during connection, it is difficult to connect the connectors. In that respect, according to the present invention, the first connector can be displaced from the reference position by the X-direction spring portion and the Y-direction spring portion. Thus, even if the connectors are decentered from each other, the X-direction spring portion and the Y-direction spring portion absorb this decentering and the connectors can be connected smoothly.

The first connector may be mounted in a state displaceable along a Z-axis direction, which is a connecting direction of the first and second connectors, with respect to the holder. If mounting positions with respect to the Z-axis direction vary between the first and second connectors, the connectors are not connected properly and locking by the lock arm may become impossible even if the second connector is displaced by a predetermined stroke. However, according to the above configuration, the first connector is displaceable along the Z-axis direction with respect to the holder. Therefore, the connectors can be brought reliably to a properly connected state by absorbing the mounting position variation in the Z-axis direction.

The Y-direction spring may be composed of a first spring piece and a second spring piece respectively formed to be deflectable along the Y-axis direction in the holder and configured to resiliently sandwich the first connector in the Y-axis direction. The first spring piece may support a surface of the first connector opposite to a surface where the lock arm is provided with respect to the Y-axis direction. The first connector may be formed with two receiving portions protruding out in the X-axis direction, and the second spring pieces may be provided to correspond to the receiving portions in the holder. The second spring pieces may hold the first connector by resiliently sandwiching the first connector in the Y-axis direction between the second spring pieces and the first spring piece. According to this configuration, the first connector is supported at the reference position in the Y-axis direction by being resiliently sandwiched and is supported by the first spring piece and the second spring pieces provided in the holder in the Y-axis direction. Even if the center axes of the first and second connectors deviate in the Y-axis direction at the time of connecting the connectors, a deviation can be absorbed by deflecting and deforming the first spring piece or the second spring pieces and smooth connection is possible.

The X-direction spring portion may be formed on each of the surfaces of the second spring pieces facing the receiving portions, and the X-direction spring portions may be inclined symmetrically down from inner sides toward outer sides along the X-axis direction. With the first connector supported by the holder, the receiving portions of the first connector receive resilient reaction forces from both second spring pieces with respect to the Y-axis direction. At this time, the surfaces of the second spring pieces facing the receiving portions are set to have a downward gradient toward outer sides in the X-axis direction as the X-direction spring portions. Thus, the resilient reaction forces from the second spring pieces act on both receiving portions inwardly along the X-axis direction, i.e. act to face each other. In this way, the first connector is supported at the reference position in the X-axis direction. Even if the center axes of the two connectors deviate in the X-axis direction at the time of connecting the first and second connectors, mutual deviations can be absorbed by deflecting and deforming both second spring pieces, with the result that smooth connection is possible.

Further, the X-direction spring portion and the Y-direction spring portion both may be formed by the second spring pieces. Therefore, the configuration of the holder can be simplified.

The second connector may be mounted on a solenoid, and the holder may be arranged on a valve body that includes a solenoid mounting portion into which the solenoid is mountable. The valve body may be equipped in a hydraulic control device of an automatic transmission of an automotive vehicle configured when the solenoid is mounted into the solenoid mounting portion, and the first and second connectors may be connectable as the solenoid is mounted into the solenoid mounting portion. According to this configuration, the hydraulic control device of the automatic vehicle can be configured by mounting the solenoid into the solenoid mounting portion. Further, the first and second connectors can be connected as the solenoid is mounted into the solenoid mounting portion.

DETAILED DESCRIPTION

Figure 1:
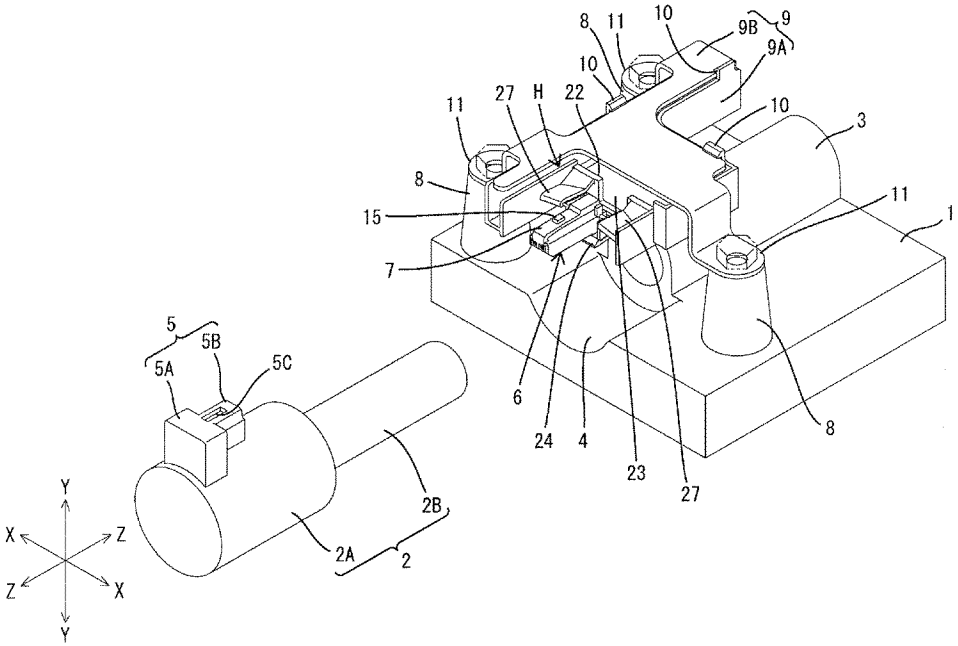
FIG. 1 is a perspective view showing a state where a first connector provided on a hydraulic control device of an automatic transmission and a second connector provided on a solenoid are separated in one embodiment.
Figure 2:
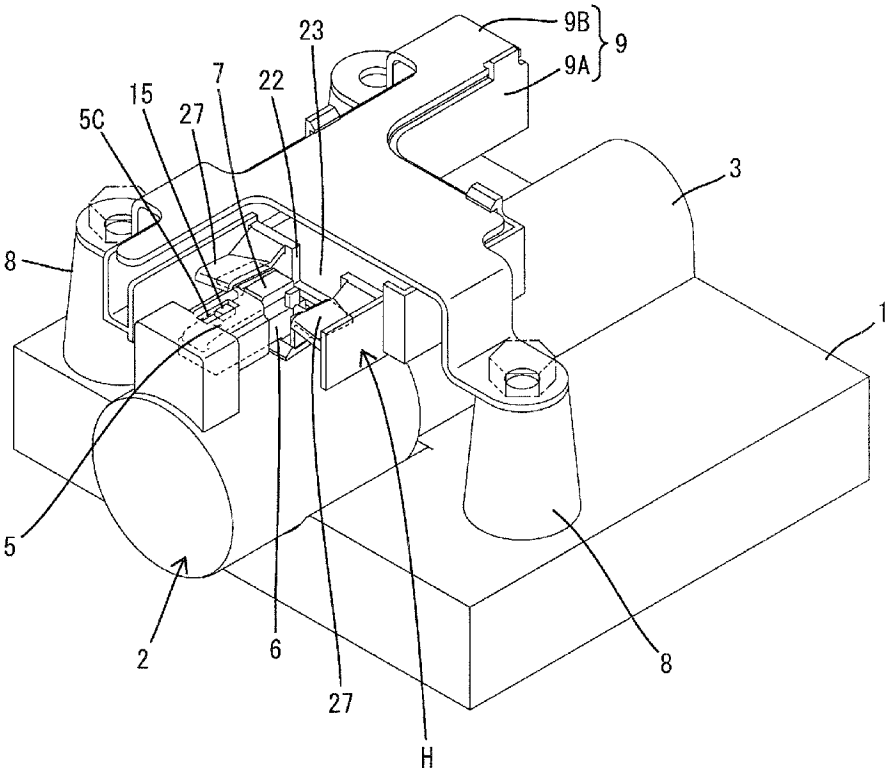
FIG. 2 is a perspective view showing a state where the first and second connectors are connected as the solenoid is mounted.

As shown in FIGS. 1 and 2, the hydraulic control device includes a valve body 1 and solenoids 2 are mounted into this valve body 1 (a state where one solenoid 2 is mounted is shown in FIG. 2). Note that although the connector with alignment function of this embodiment is provided in correspondence with each solenoid 2, only one is shown in FIGS. 1 and 2 and only this one is described below.

The valve body 1 is provided with a solenoid mounting portion 3 for mounting the solenoid 2. The solenoid mounting portion 3 is in the form of a substantially horizontally oriented cylinder projecting from an outer surface of the valve body 1, and a concave surface 4 fittable to the outer peripheral surface of an electromagnetic portion 2A of the solenoid 2 is formed by recessing a part of the valve body 1 before the solenoid mounting portion 3.

The solenoid 2 is formed into a substantially cylindrical shape and is composed of the electromagnetic portion 2A and a valve portion 2B. The valve portion 2B is formed to have a smaller diameter than the electromagnetic portion 2A and is insertable into the solenoid mounting portion 3. When the valve portion 2B is inserted properly into the solenoid mounting portion 3, a step formed on a boundary between the valve portion 2B and the electromagnetic portion 2A comes into contact with the front end surface of the solenoid mounting portion 3 and, in that state, the solenoid 2 is locked in a mounted state by an unillustrated lock means. When the valve portion 2B is inserted in this way, a hydraulic circuit (not shown) for a hydraulic control is configured between the valve portion 2B and the solenoid mounting portion 3.

A second connector 5 (male connector) constituting the connector with alignment function projects on the outer peripheral surface of the electromagnetic portion 2A. The second connector 5 is composed of a base 5A projecting from the outer peripheral surface of the electromagnetic portion 2A and a tubular receptacle 5B projecting from this base 5A in parallel to an axial line of the solenoid 2 and open forward. A male terminal fitting (not shown) to be connected to the solenoid 2 projects in the receptacle 5B. A lock hole 5C is open on an outer surface of the receptacle 5B. When a first connector 6 (female connector) to be described later and the second connector 5 are properly connected, a lock arm 7 of the first connector 6 can be locked into the lock hole 5C.

Bosses 8 for supporting a harness accommodating portion 9 project at a total of three positions on the outer surface of the valve body 1 described above. Two bosses 8 are arranged at one side of the solenoid mounting portion 3 and one is arranged at an opposite side. Wires W drawn out from the first connector 6 to be described later are arranged in the harness accommodating portion 9.

As shown in FIGS. 1 and 2 the harness accommodating portion 9 is composed of an accommodating main body 9A made of resin and a cover 9B made of metal. The accommodating main body 9A is formed into a gutter open upward and the cover 9B covers an opening surface of the accommodating main body 9A. Lock claws 10 stand at a plurality of positions of the accommodating main body 9A and are locked resiliently to the cover 9B so that the accommodating main body 9A and the cover 9B are integrated. The cover 9B extends in three directions and a mounting piece 11 is formed on each extending end part. Each mounting piece 11 is placed on the upper surface of the boss 8 and is fastened to the boss 8 by a screw so that the entire harness accommodating portion 9 is supported in a suspended state.

The accommodating main body 9A of the harness accommodating portion 9 is formed integrally with a holder H. As shown in FIG. 1, the first connector 6 is mounted in the holder H and defines a waiting-side connector for the second connector 5. Note that a connecting direction of the second connector 5 to the first connector 6 is referred to as a Z-axis direction below.

Figure 3:
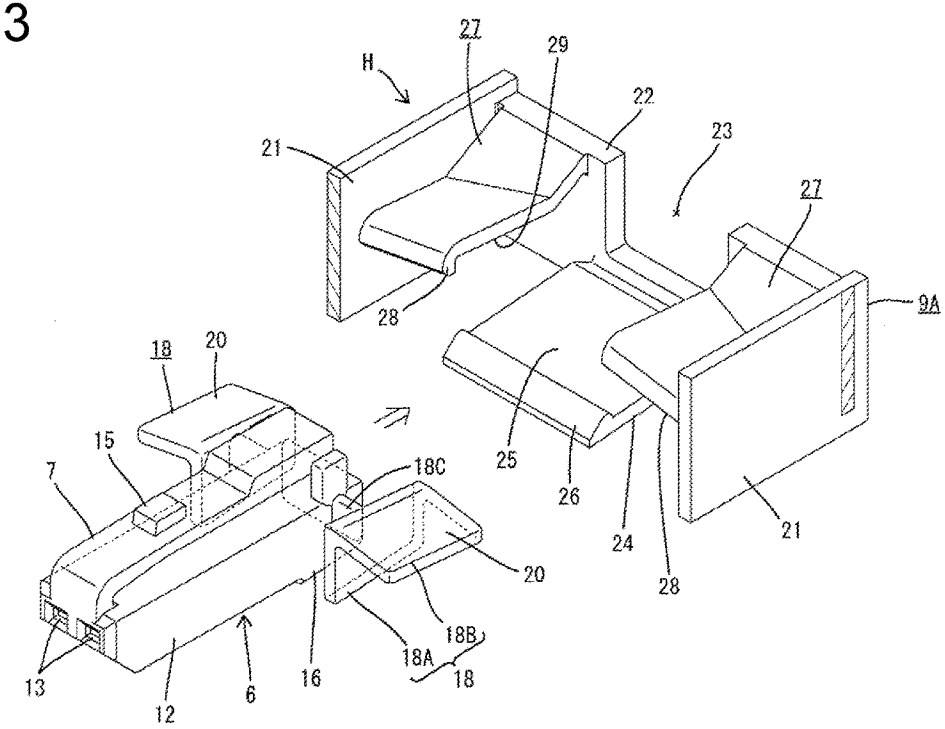
FIG. 3 is an exploded perspective view showing the first connector and a holder portion.
Figure 4:
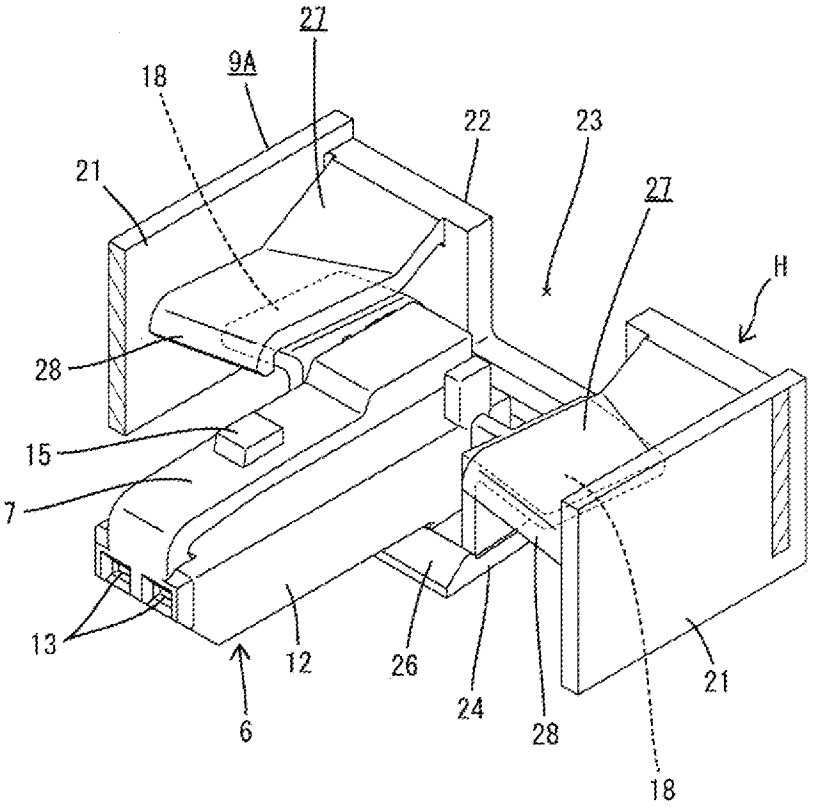
FIG. 4 is a perspective view showing a state where the first connector is mounted in the holder portion.

The first connector 6 is described mainly with reference to FIG. 3. The first connector 6 includes a connector housing 12 made of resin. Two left and right cavities 13 are formed in the connector housing 12, and a female terminal fitting 14 is accommodated in each cavity 13. The lock arm 7 is provided on the upper surface of the connector housing 12. The lock arm 7 is cantilevered along a longitudinal direction from an end part on a connection surface side of the connector housing 12 and is deflectable in a vertical direction (hereinafter, a deflecting direction of the lock arm 7 is referred to as a Y-axis direction). A lock protrusion 15 is formed to project at an intermediate position in the longitudinal direction on the upper surface of the lock arm 7.

Figure 7:
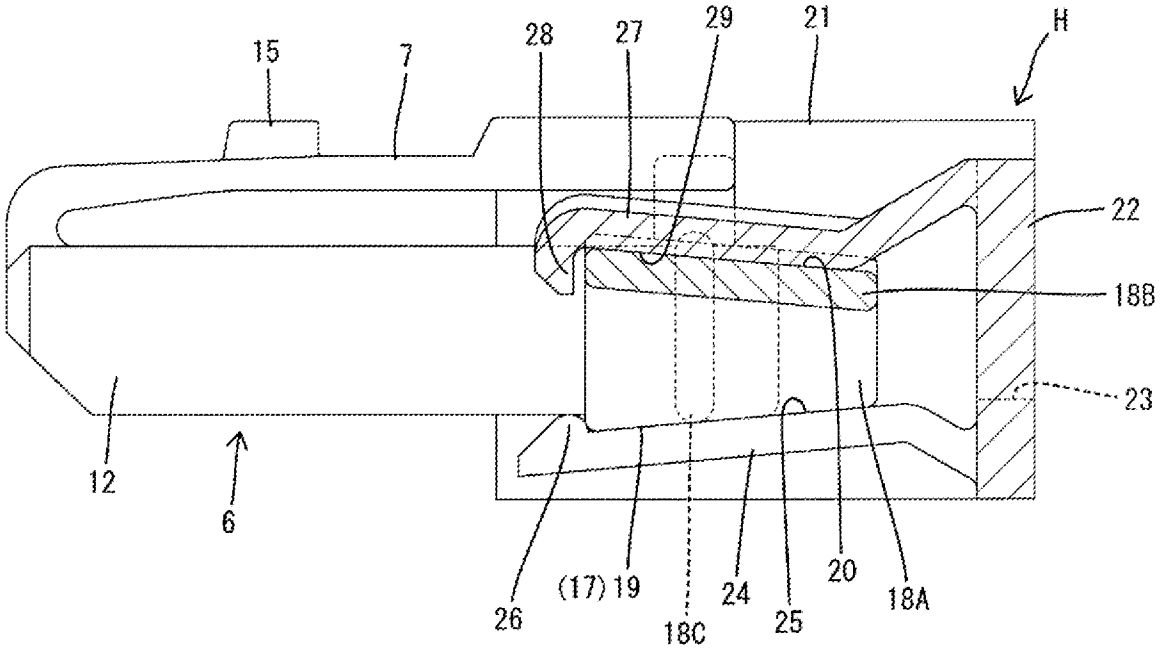
FIG. 7 is a section along B-B of FIG. 5.

As shown in FIG. 7, a rear part of the lower surface (surface opposite to the surface where the lock arm 7 is formed) of the connector housing 12 is slightly larger and projects to form a step 16 between the rear part and a part before this. Further, the lower surface of the step 16 is formed into a lower inclined surface 17 inclined up toward the back.

Two receiving portions 18 are provided at opposite sides of the rear part of the connector housing 12 in a width direction (hereinafter, this direction perpendicular to Z and Y axes is referred to as an X-axis direction). As shown in FIG. 3, each receiving portion 18 has a side piece 18A and a receiving piece 18B protruding outwardly in the X-axis direction from the upper edge of the side piece 18A. The receiving portions 18 are formed symmetrically while being substantially inverted L-shaped in a front view. Further, the side pieces 18A of the receiving portions 18 are connected to both side surfaces of the connector housing 12 facing in the width direction via vertically formed coupling pieces 18C. Thus, the entire receiving portions 18 are imparted with such rigidity as not to be easily deflected and deformed and are formed to be substantially undeflectable.

Figure 6:
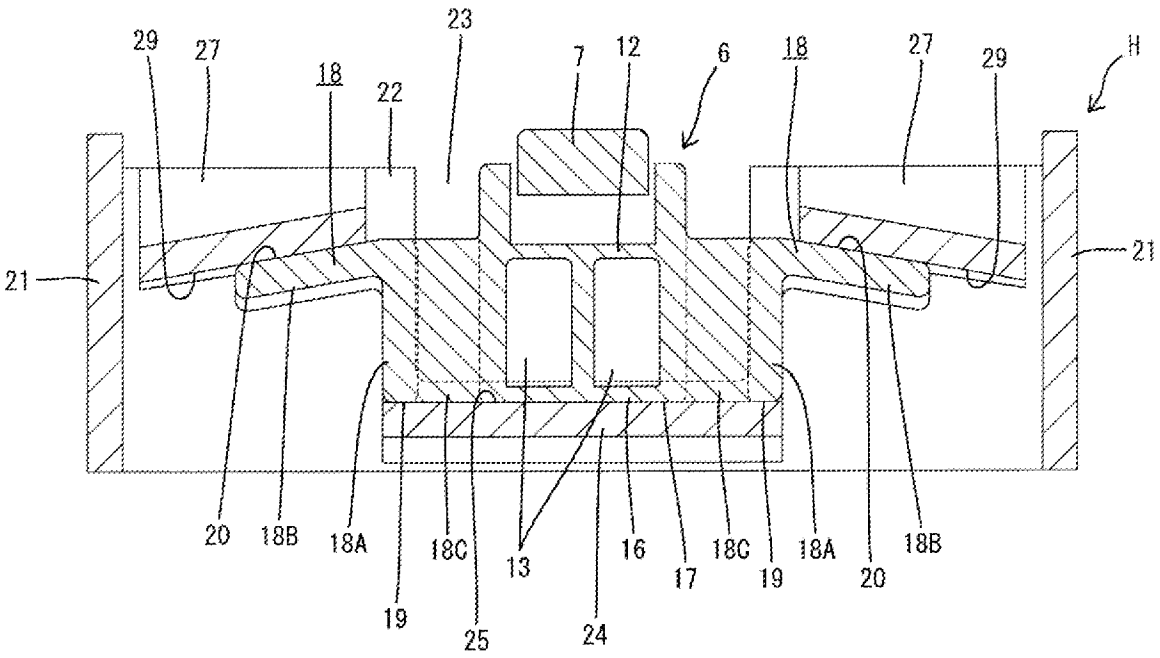
FIG. 6 is a section along A-A of FIG. 5.

As shown in FIG. 6, the lower ends of the side pieces 18A and the coupling pieces 18C are flush with the lower surface of the step 16 of the connector housing 12. Further, as also shown in FIG. 7, the lower edges of the side pieces 18A also are formed with lower inclined surfaces 19 having such a gradient as to be flush with the lower inclined surface 17 of the step 16.

Upper inclined surfaces 20 are symmetrically formed on the upper surfaces of the receiving pieces 18B of both receiving portions 18. Specifically, the upper inclined surfaces 20 are set to have such a downward gradient to be inclined gradually down toward outer sides in the width direction (X-axis direction), as shown in FIG. 6, and also are set to have a downward gradient toward the back (Z-axis direction), as shown in FIG. 7.

As shown in FIG. 3, the holder H includes side plates 21 integrally formed to the accommodating main body 9A and facing each other in the X-axis direction. A cut window 23 is formed on a holder forming wall 22 of the accommodating main body 9A connecting the side plates 21, and the wires W drawn out from the first connector 6 can be accommodated into the harness accommodating portion 9 through this cut window 23.

In mounting the solenoid 2 into the valve body 1, center axes of the first and second connectors 6, 5 are aligned in a state where a center axis of the solenoid mounting portion 3 and that of the solenoid 2 are aligned (squarely facing state). When the solenoid 2 is inserted to a proper depth into the valve body 1 and the mounting is completed, a mounting operation of the solenoid 2 and a connecting operation of the first and second connectors 6, 5 can be performed simultaneously if the connectors 5, 6 are connected to a proper depth and locking by the lock arm 7 is effected. However, if there is a connection error between the first and second connectors 6, 5 with respect to the X-axis, Y-axis and Z-axis directions, the connecting operation of the first and second connectors 6, 5 cannot be performed simultaneously with the mounting operation of the solenoid 2. In view of such a situation, mechanisms for absorbing a connection error between the connectors 5, 6 are set in the holder H in this embodiment.

Figure 5:
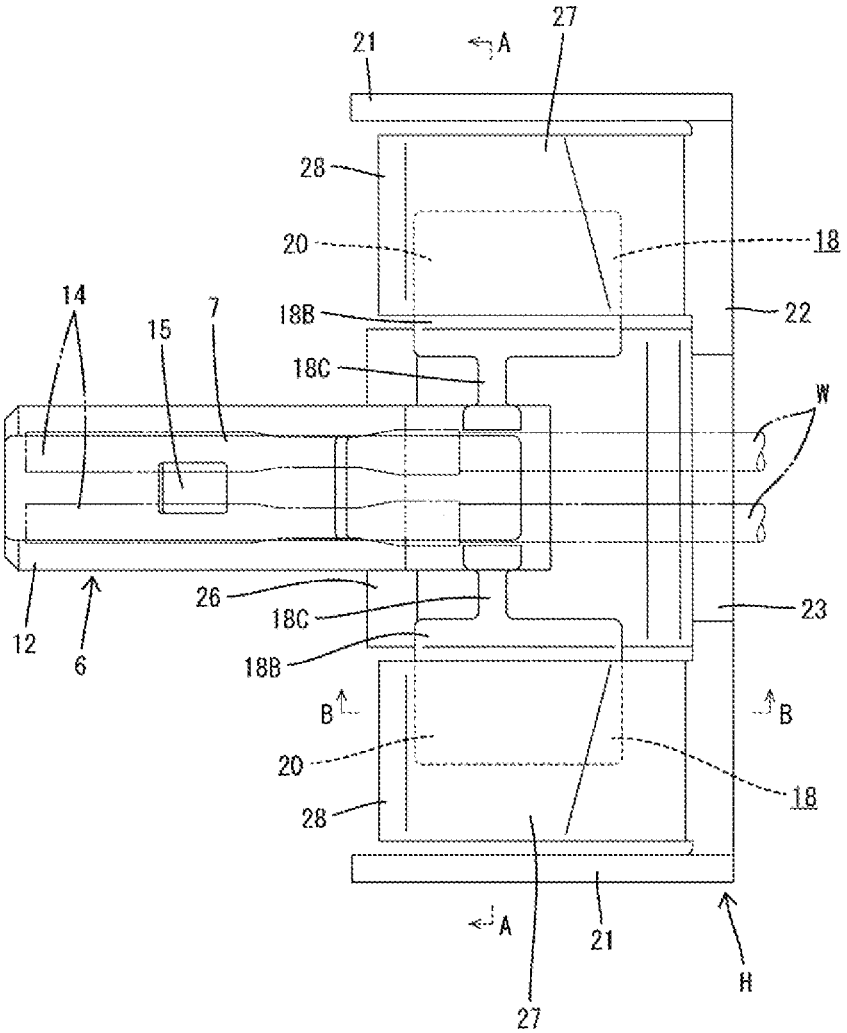
FIG. 5 is a plan view showing the state of FIG. 4.

First, the mechanism for absorbing a connection error with respect to the Y-axis direction is described. As shown in FIG. 3, a first spring piece 24 is formed on the holder forming wall 22 of the accommodating main body 9A. The first spring piece 24 is cantilevered to protrude forward from the lower edge of the cut window 23 and is deflectable along the Y-axis direction. A width of the first spring piece 24 along the Y-axis direction is larger than an opening width of the cut window 23, as shown in FIG. 5 and is substantially equal to a dimension between the outer surfaces of the side pieces 18A of the first connector, as shown in FIG. 6. As shown in FIG. 6, the first spring piece 24 has the step 16 of the connector housing 12 and the side pieces 18A are placed thereon to support the first connector 6 from below.

As shown in FIG. 7, a base end part of the first spring piece 24 is formed to extend obliquely up, but a lower receiving surface 25 having a gradient compatible with that of the lower inclined surfaces 17, 19 of the first connector 6 is formed on a side of the first spring piece 24 before the base end part. Further, a locking claw 26 is formed to project up over the entire width on the front edge of the first spring piece 24 and can be locked to the front end surface of the step 16 of the first connector 6.

Two second spring pieces 27 are provided on the holder forming wall 22 of the accommodating main body 9A at opposite sides of the cut window 23 in the X-axis direction. Both second spring pieces 27 are deflectable in the Y-axis direction and constitute a Y-direction spring portion of the present invention together with the first spring piece 24.

Both second spring pieces 27 are cantilevered forward from the upper edge of the holder forming wall 22. As shown in FIG. 5, the front ends of the second spring pieces 27 are located substantially at the same position as or slightly behind the front end of the first spring piece 24. The outer side edges of both second spring pieces 27 are separated from the side plates 21 of the holder H and the inner side edges thereof are located outward of the outer edge edges of the first spring piece 24. The front end edges of both second spring pieces 27 are bent down and are formed into retaining claws 28 that are locked to the front edges of the receiving portions 18 of the first connector 6 and act together with the locking claw 26 to prevent the first connector 6 from coming out forward from the holder H.

As shown in FIG. 3 and the like, base ends of both second spring pieces 27 are formed to extend obliquely down, but upper receiving surfaces 29 are formed on sides of the second spring pieces 27 before the base ends, as shown in FIGS. 6 and 7. As shown in FIG. 7, the upper receiving surface 29 has an upward gradient toward the front (in a direction along the Z-axis direction) and this gradient is compatible with that of the upper inclined surface 20 with respect to the Z-axis direction. Further, as shown in FIG. 6, the upper receiving surfaces 29 also have a downward gradient toward widthwise outer sides (X-axis direction) and this gradient is compatible with that of the upper inclined surfaces 20 with respect to the X-axis direction.

In a state mounted in the holder H, the first connector 6 is sandwiched resiliently in the Y-axis direction by the first and second spring pieces 24, 27 while deflecting and deforming each of these spring pieces 24, 27. Specifically, the first and second spring pieces 24, 27 bias the first connector 6 together toward a reference position to be described later, with the result that the first connector 6 is held at a position with respect to the Y-axis direction where resilient reaction forces of the spring pieces 24, 27 are balanced (reference position).

As described above, the upper receiving surfaces 29 of both second spring pieces 27 are set to have the downward gradient toward the widthwise (X-axis direction) outer sides, as shown in FIG. 6. On the upper receiving surfaces 29, components of the gradients in the direction along the X-axis direction constitutes an X-direction spring portion of the present invention. Specifically, with the first connector 6 mounted in the holder H, resilient reaction forces act on the first connector 6 from the first and second spring pieces 24, 27. These resilient reaction forces act to bias the first connector 6 together toward the reference position along the X-axis direction by the gradient components of the upper receiving surfaces 29 in the X-axis direction. As a result, the first connector 6 is held at a position where the resilient reaction forces of both second spring pieces 27 are balanced (reference position) with respect to the X-axis direction.

In this way, the first connector 6 is held at the neutral reference position with respect to the X-axis direction and the Y-axis direction by the first and second spring pieces 24, 27. In other words, the reference position means a position where a center axis of the first connector 6 along the longitudinal direction is located right above that of the solenoid mounting portion 3, into which the solenoid 2 is to be inserted, with respect to the X-axis direction and a distance from the center axis of the solenoid mounting portion 3 to that of the first connector 6 in the longitudinal direction is equal to a distance from the center axis of the solenoid 2 to that of the second connector 5 in the longitudinal direction with respect to the Y-axis direction.

Further, in the state mounted in the holder H, the first connector 6 is displaceable by a predetermined length along the Z-axis direction. A front end position of the first connector 6 with respect to the Z-axis direction is a position where the locking claw 26 of the first spring piece 24 is locked in contact with the front end edge of the step 16 of the first connector 6 as shown in FIG. 7. A rear end position of the first connector 6 with respect to the Z-axis direction is a position where the rear end edges of both second spring pieces 27 are in contact with the holder forming wall 22 of the accommodating main body 9A.

Note that a frictional force generated between the first connector 6 and the first and second spring pieces 24, 27 when connecting the first and second connectors 6, 5 is set to exceed a frictional force between the first and second connectors 6, 5. Thus, the first and second connectors 6, 5 are locked into a connected state with a light force. However, when the connectors 5, 6 are connected, the solenoid 2 is locked to the solenoid mounting portion 3 so that the first and second connectors 6, 5 are not separated inadvertently.

Next, functions and effects of this embodiment configured as described above are described. Initially, the first connector 6 is mounted into the holder H from the front. In this case, the first connector 6 is pushed into the holder H by deflecting and deforming the first and second spring pieces 24, 27 away from each other. In this way, the first connector 6 is supported in a fitted state where the step 16 and the side pieces 18A of both receiving portions 18 are on the lower inclined surface 25 of the first spring piece 24. Further, at this time, the upper inclined surfaces 20 of both receiving portions 18 are resiliently in contact with the upper receiving surfaces 29 of the corresponding second spring pieces 27 in a substantially fitted state.

When the first connector 6 is mounted into the holder H in this way, the first connector 6 is held at the neutral position (reference position) with respect to the Y-axis direction, since the resilient reaction forces of the first and second spring pieces 24, 27 are acting in a balanced manner with respect to the Y-axis direction. Further, the gradient components of the upper receiving surfaces 29 of the second spring pieces 27 in the X-axis direction ensure that the resilient reaction forces act with each other in mutually opposite directions along the X-axis direction and are balanced. Thus, the first connector 6 is held at the neutral position (reference position) also with respect to the X-axis direction. As a result of the above, the first connector 6 is floating-supported at the reference position.

Subsequently, the valve 2B of the solenoid 2 is inserted into the solenoid mounting portion 3. At this time, if the solenoid mounting portion 3 is squarely facing the valve 2B of the solenoid 2 (state where the center axes thereof are aligned) and the second connector 5 is squarely facing the first connector 6, the second connector 5 is connected properly to the first connector 6 and the lock protrusion 15 of the lock arm 7 is locked into the lock hole 5C of the second connector 5 to hold a connected state as the solenoid 2 is inserted to a proper depth into the solenoid mounting portion 3.

On the other hand, even if the second connector 5 is not squarely facing the first connector 6 and the center axes of the connectors deviate or are inclined in the X-axis or Y-axis direction in a state where the valve portion 2B of the solenoid 2 is squarely facing the solenoid mounting portion 3, a front end part of the first connector 6 is guided and lightly inserted into the receptacle 5B of the second connector 5. Thus, the first connector 6 is displaced in the X-axis and Y-axis directions and guided to a state properly connected to the second connector 5 by deflecting and deforming the second spring pieces 27. If the first and second connectors 6, 5 are connected properly in this way, male and female terminal fittings are connected properly.

Further, if there is an error between a connection stroke of the solenoid 2 to the solenoid mounting portion 3 and a connection stroke of the second connector 5 to the first connector 6, the first and second connectors may not be connected properly (state where the locking protrusion is not locked to the lock arm 7) even if the connection of the solenoid 2 to the solenoid mounting portion 3 is completed or, conversely, the solenoid 2 may not reach the proper depth with respect to the solenoid mounting portion 3 even if the properly connected state of the connectors 5, 6 holds. However, since the first connector 6 is displaceable by a predetermined stroke in the holder H with respect to the Z-axis direction, i.e. between a position where the locking claw 26 of the first spring piece 24 is locked to a step of the inclined surface of the first connector 6 and a position where the rear end edges of the second spring pieces 27 are in contact with side walls of the accommodating main body 9A in this embodiment, a deviation in the Z-axis direction can also be absorbed. Therefore, even if there is a stroke variation in the Z-axis direction between the mounting of the solenoid 2 and the connection of the connectors 5, 6, both the properly mounted state of the solenoid 2 and the properly connected state of the both connectors can be realized.

As described above, the first connector 6 is supported displaceably in any of the X-axis, Y-axis and Z-axis directions with respect to the holder H. Thus, the connecting operation of the connectors can smoothly and efficiently proceed by three-dimensionally and widely absorbing assembling variations between the both connectors 5, 6. Further, since the first connector 6 has a basic assembling position determined with respect to the X-axis and Y-axis directions due to an exhibited alignment function although being held in the state displaceable with respect to the holder H, initial decentering between the connectors can be reduced, which can contribute to smooth connection of the connectors.

Further, in this embodiment, the second spring pieces 27 are set to have both a function as the Y-direction spring portion and a function as the X-direction spring portion. Thus, the configuration of the holder H can be simplified as compared to the case where these functions are set separately.

The invention is not limited to the above described and illustrated embodiment. For example, the following embodiments are also included in the technical scope of the present invention.

Although the holder H is formed integrally to the harness accommodating portion 9 in the above embodiment, it may be formed separately formed.

Although one of the Y-direction spring portions and the X-direction spring portion are provided on the second spring pieces 27 in the above embodiment, these spring portions may be provided separately provided in the holder portion H.

Although the receiving portions 18 are formed into plates in the above embodiment, they may be formed into blocks to enhance rigidity more.

LIST OF REFERENCE SIGNS

5 . . . second connector
6 . . . first connector
7 . . . lock arm
18 . . . receiving portion
24 . . . first spring piece (Y-direction spring portion)
27 . . . second spring piece (Y-direction spring portion)
29 . . . upper receiving surface (X-direction spring portion)
H . . . holder (holder)

The invention claimed is:

1. A connector with alignment function, comprising:

a first connector including a deflectable lock arm;

a holder, the first connector being mountable into the holder and being a waiting side; and a second connector connectable to the first connector and lockable by the lock arm, wherein:

a plurality of spring portions for aligning the first connector with a reference position are interposed between the holder and the first connector; and the plurality of spring portions include:

a Y-direction spring portion arranged at a position across a center axis at the time of connecting the first and second connectors in a Y-axis direction, which is a deflecting direction of the lock arm, and configured to bias the first connector toward the reference position; and an X-direction spring portion arranged at a position across the center axis in an X-axis direction, which is a direction perpendicular to the Y-axis, and configured to bias the first connector toward the reference position.

2. The connector with alignment function of claim 1, wherein the first connector is mounted in a state displaceable along a Z-axis direction, which is a connecting direction of the first and second connectors, with respect to the holder.

3. The connector with alignment function of claim 2, wherein:

the Y-direction spring portion is composed of a first spring piece and a second spring piece respectively formed to be deflectable along the Y-axis direction in the holder and configured to resiliently sandwich the first connector in the Y-axis direction;

the first spring piece supports a surface of the first connector opposite to a surface where the lock arm is provided with respect to the Y-axis direction;

the first connector is formed with two receiving portions protruding outwardly in the X-axis direction; and two second spring pieces are provided to correspond respectively to the receiving portions in the holder and the second spring pieces hold the first connector by resiliently sandwiching the first connector in the Y-axis direction between the second spring pieces and the first spring piece.

4. The connector with alignment function of claim 3, wherein the X-direction spring portion is formed on each of surfaces of the second spring pieces facing the receiving portions and the X-direction spring portions are formed to be symmetrically inclined downwardly from inner sides toward outer sides along the X-axis direction.

5. The connector with alignment function of claim 4, wherein:

the second connector is mounted on a solenoid;

the holder is arranged on a valve body including a solenoid mounting portion, into which the solenoid is mountable, and the valve body is equipped in a hydraulic control device of an automatic transmission of an automotive vehicle configured when the solenoid is mounted into the solenoid mounting portion; and the first and second connectors are connectable as the solenoid is mounted into the solenoid mounting portion.

6. The connector with alignment function of claim 1, wherein:

the Y-direction spring portion is composed of a first spring piece and a second spring piece respectively formed to be deflectable along the Y-axis direction in the holder and configured to resiliently sandwich the first connector in the Y-axis direction;

the first spring piece supports a surface of the first connector opposite to a surface where the lock arm is provided with respect to the Y-axis direction;

the first connector is formed with two receiving portions protruding outwardly in the X-axis direction; and two second spring pieces are provided to correspond respectively to the receiving portions in the holder and the second spring pieces hold the first connector by resiliently sandwiching the first connector in the Y-axis direction between the second spring pieces and the first spring piece.

7. The connector with alignment function of claim 1, wherein the X-direction spring portion is formed on each of surfaces of the second spring pieces facing the receiving portions and the X-direction spring portions are formed to be symmetrically inclined downwardly from inner sides toward outer sides along the X-axis direction.

8. The connector with alignment function of claim 1, wherein:

the second connector is mounted on a solenoid;

the holder is arranged on a valve body including a solenoid mounting portion, into which the solenoid is mountable, and the valve body is equipped in a hydraulic control device of an automatic transmission of an automotive vehicle configured when the solenoid is mounted into the solenoid mounting portion; and the first and second connectors are connectable as the solenoid is mounted into the solenoid mounting portion.

* * * * *